US010987528B2

(12) United States Patent
Wang et al.

(10) Patent No.: US 10,987,528 B2
(45) Date of Patent: Apr. 27, 2021

(54) FALL PROTECTION DEVICE

(71) Applicant: YOKE INDUSTRIAL CORP., Taichung (TW)

(72) Inventors: Jyu-Yi Wang, Changhua (TW); Wei-Chieh Hung, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 99 days.

(21) Appl. No.: 16/194,049

(22) Filed: Nov. 16, 2018

(65) Prior Publication Data

US 2020/0078620 A1 Mar. 12, 2020

(30) Foreign Application Priority Data

Sep. 11, 2018 (TW) ..... 107131906

(51) Int. Cl.
*A62B 35/00* (2006.01)
*B65H 75/40* (2006.01)
*B65H 75/44* (2006.01)

(52) U.S. Cl.
CPC ..... *A62B 35/0093* (2013.01); *B65H 75/40* (2013.01); *B65H 75/4442* (2013.01)

(58) Field of Classification Search
CPC ..... A62B 1/08; A62B 1/10; A62B 35/0093
See application file for complete search history.

(56) References Cited

U.S. PATENT DOCUMENTS 3,915,432 A * 10/1975 Bustamante ..... B66D 1/06 182/239
4,457,400 A * 7/1984 Donaldson ..... A62B 1/10 182/234
4,480,716 A * 11/1984 Soubry ..... A62B 1/12 182/233

(Continued)

FOREIGN PATENT DOCUMENTS

CN 206007836 U 3/2017
CN 107954384 A 4/2018

(Continued)

OTHER PUBLICATIONS

Examination Report for TW107131906, dated Jun. 19, 2019, Total of 6 pages.

(Continued)

*Primary Examiner* — Colleen M Chavchavadze
(74) *Attorney, Agent, or Firm* — Tracy M. Heims; Apex Juris, PLLC.

(57) ABSTRACT

A fall protection device is used to connect with a safety belt, including a frame having a receiving space, a shaft disposed on the frame, a decelerating member connected to the shaft and disposed in the receiving space, and a safety belt base fitted around the decelerating member. An outer peripheral surface of the decelerating member has a plurality of friction surfaces arranged at intervals. The safety belt base has an outer peripheral surface adapted to be wrapped by the safety belt and an inner peripheral surface being in contact with the friction surfaces thereof. With the design describing above, (Continued)

the friction surfaces rub the inner peripheral surface to generate a rolling friction, thereby to slow down an unwound speed of the safety belt.

9 Claims, 7 Drawing Sheets

(56) References Cited

U.S. PATENT DOCUMENTS

| | | | | |
|---|---|---|---|---|
| 4,729,454 | A * | 3/1988 | Barelli | A62B 1/10 182/234 |
| 5,186,289 | A * | 2/1993 | Wolner | A62B 1/12 182/232 |
| 5,351,906 | A * | 10/1994 | Feathers | A62B 1/10 182/237 |
| 6,182,789 | B1 * | 2/2001 | Okamura | A62B 1/02 182/7 |
| 7,237,651 | B2 * | 7/2007 | Avots | A62B 1/10 182/234 |
| 8,490,750 | B2 * | 7/2013 | Balquist | A62B 35/0093 182/231 |
| 8,701,833 | B2 * | 4/2014 | Marquardt | A62B 1/10 182/231 |
| 9,121,462 | B2 * | 9/2015 | Casebolt | A62B 1/10 |
| 9,861,841 | B1 | 1/2018 | Hung | |
| 10,151,361 | B2 * | 12/2018 | Gross | F16D 49/10 |
| 2008/0210488 | A1 * | 9/2008 | Tarkhani | A62B 1/10 182/5 |
| 2008/0314685 | A1 * | 12/2008 | Verstegen | A62B 1/10 182/231 |
| 2012/0048651 | A1 * | 3/2012 | Rinklake | B66D 5/16 182/234 |
| 2012/0061183 | A1 * | 3/2012 | Michael | A62B 1/10 182/231 |
| 2012/0067670 | A1 * | 3/2012 | Rinklake | F16D 43/16 182/234 |
| 2014/0251731 | A1 * | 9/2014 | Jones | A62B 35/04 182/231 |
| 2018/0178046 | A1 * | 6/2018 | Sepe | A62B 35/04 |

FOREIGN PATENT DOCUMENTS

| | | |
|---|---|---|
| TW | M529525 U | 10/2016 |
| TW | M572764 U | 1/2019 |

OTHER PUBLICATIONS

Search Report for TW107131906, dated Jun. 19, 2019, Total of 1 page.
English Abstract for CN107954384, Total of 1 page.
English Abstract for CN206007836, Total of 1 page.
English Abstract for TWM529525, Total of 1 page.
English Abstract for TWM572764, Total of 1 page.
Examination Search Report for 18206927.8, dated Apr. 16, 2019, Total of 8 pages.

* cited by examiner

FALL PROTECTION DEVICE

BACKGROUND OF THE INVENTION

Technical Field

The invention relates generally to a fall protection device, and more particularly to a fall protection device for using in an elevated work site.

Description of Related Art

Generally, those who work at an elevated work site, such as roof, factory, elevator repair, shipyard, aerospace base, construction site, and etc., will equip with safety parts such as a fall protection device (i.e., a fall arrester). The fall protection device usually mates with a safety belt and is connected to the safety belt, wherein an end of the safety belt is attached to a user. In this way, when the user inattentively falls from the elevated work site, the fall protection device could lock or cushion the safety belt to prevent the user from continuing falling or to slow down the falling speed of the user, ensuring the user's safety.

A safety belt of a conventional fall protection device is stretchable so that when a user attached to the safety belt falls, the flexible safety belt could cushion or slow down the falling speed of the user. However, there are many factors should be considered as producing the conventional fall protection device, such as the length of the safety belt, the elastic modulus of the safety belt, the height of the place where the user works, the user's weight, and so on. The tragedy could happen if the length of the safety belt does not match with the height of the place the user works. For example, the length of the safety belt is longer than the height of the place, so that before the safety belt works the users have already hit the ground.

In addition, a safety belt of another conventional fall protection device is partially folded and sewed. In this way, when a user attached to the safety belt falls, the sewed portion of the safety belt would be torn and be unfolded due to the falling force, thereby to absorb the falling energy of the user, providing a cushioning effect. However, the tearing process destructs the structure of the safety belt, which not only weakens the rigidity of the safety belt but also reduces the loading ability of the safety belt.

Furthermore, there is still another conventional fall protection device prevents the user from falling by providing a quick-locked effect. More specifically, when a user which is attached to a safety belt connected to the conventional fall protection device falls and pulls the safety belt, the fall protection device will hold the safety belt immediately, keeping the safety belt from being continuously stretched or unrolled. Though such design could allow the user to stop falling immediately, an instantaneous impact force (such as G-Force) and a reaction force generated at the moment of an emergency stop may cause internal injuries or even bone fractures. Hence, the conventional fall protection device still has room for improvement.

BRIEF SUMMARY OF THE INVENTION

In view of the above, the purpose of the present invention is to provide a fall protection device, which could prevent the user from falling from an elevated work site with high speed. Moreover, the fall protection device in accordance with the present invention could be easily produced, which takes less time.

To achieve the objective of the present invention, the present invention provides a frame, a shaft, a decelerating member, and a safety belt base, wherein the frame has a receiving space. The shaft is disposed on the frame. The decelerating member is connected to the shaft and is received in the receiving space, wherein an outer peripheral surface of the decelerating member has a plurality of friction surfaces arranged at intervals. The safety belt base, which is fitted around the decelerating member has an outer peripheral surface and an inner peripheral surface, wherein the outer peripheral surface is adapted to be wrapped or be wound by the safety belt, and the inner peripheral surface is in contact with the plurality of friction surfaces of the decelerating member.

With the friction surfaces of the decelerating member being in contact with the inner peripheral surface of the safety belt base, when the user attached by the safety belt inattentively falls from the elevated work site, the friction surfaces of the decelerating member rubs the inner peripheral surface to generate a rolling friction, thereby to slow down or to limit the falling speed of the user.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
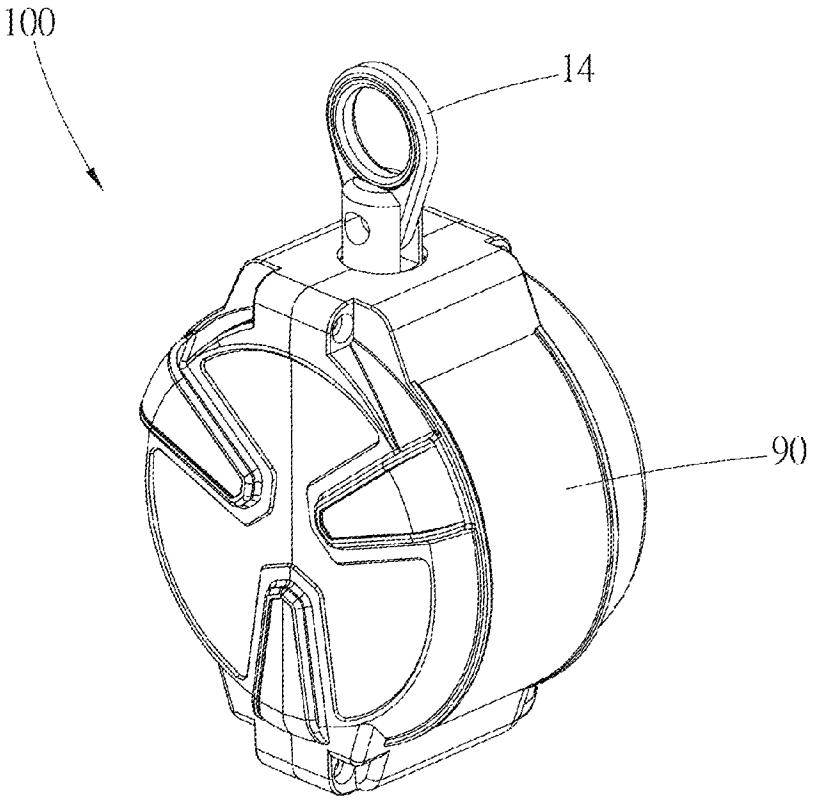
FIG. 1 is a perspective view of the fall protection device of an embodiment according to the present invention.
Figure 2:
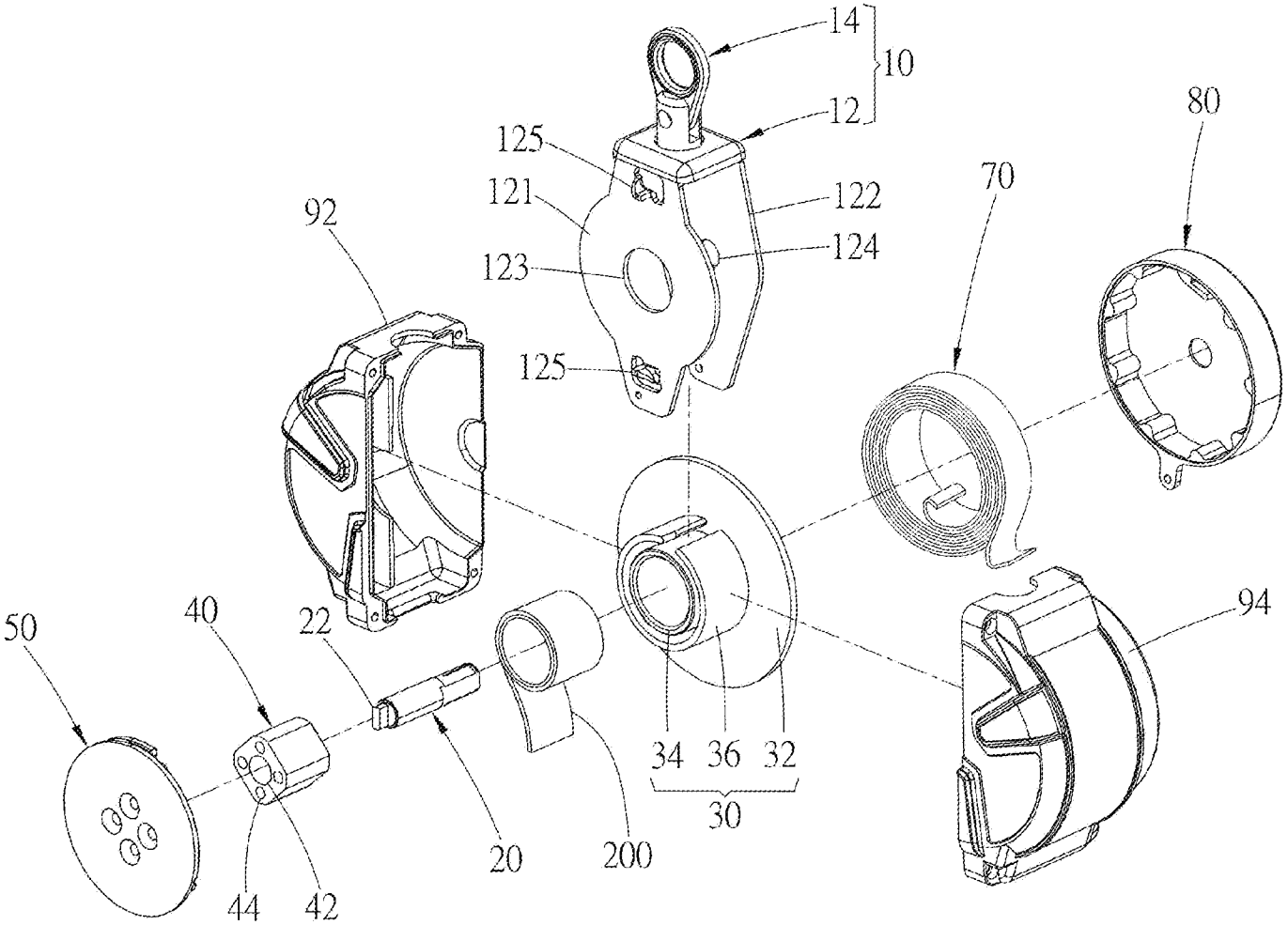
FIG. 2 is an exploded view of the fall protection device according to the embodiment shown in FIG. 1.
Figure 3:
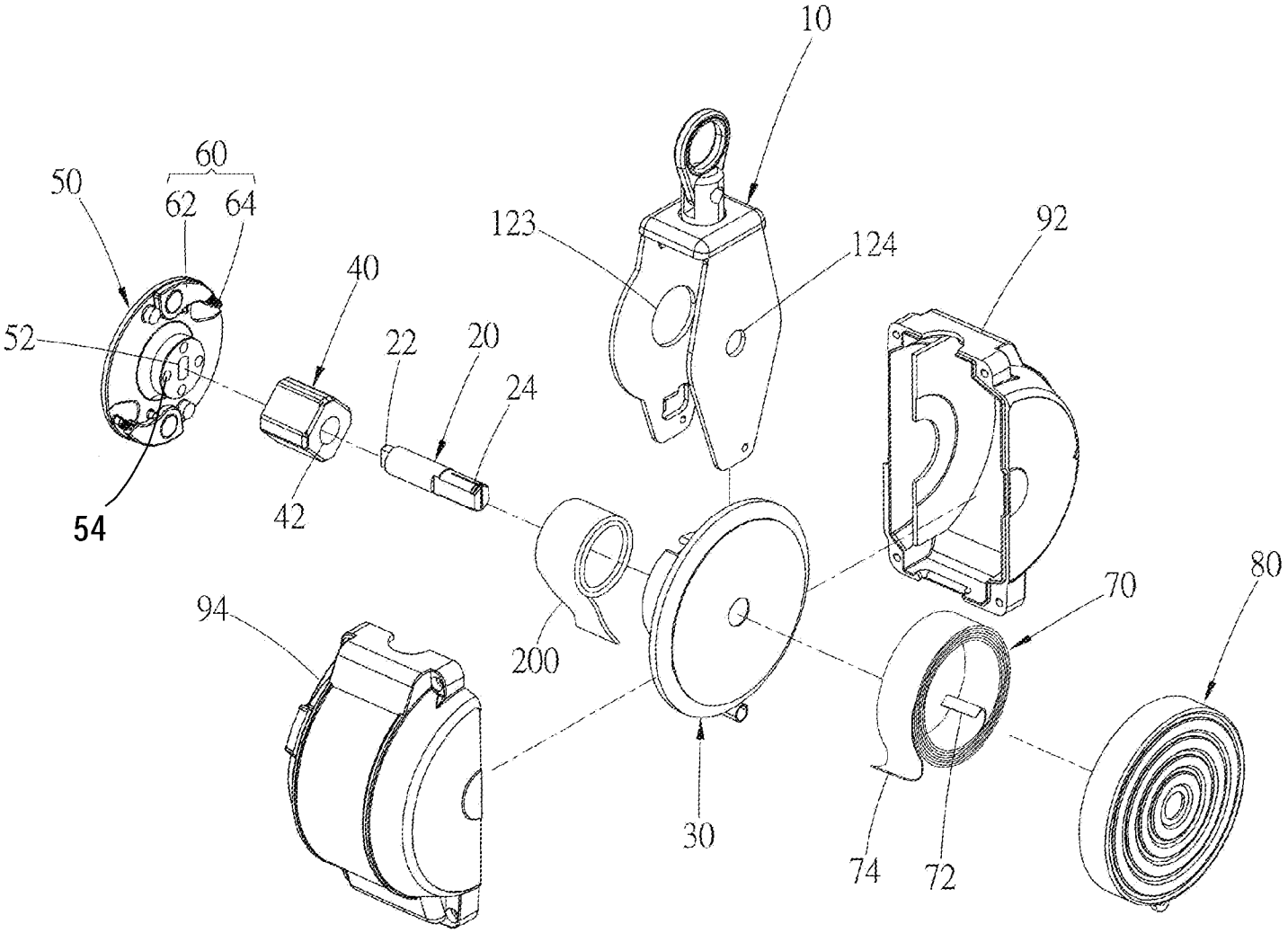
FIG. 3 is an exploded view of the fall protection device according to the embodiment shown in FIG. 1.

The invention will be described more fully hereinafter with reference to the accompanying drawings. As shown in FIG. 1 to FIG. 7, it is an embodiment of a fall protection device 100 which is provided to connects with a safety belt 200. The fall protection device 100 includes a frame 10, a shaft 20, a safety belt base 30, and a decelerating member 40. Besides, in the current embodiment, the fall protection device 100 further includes a braking plate 50, a braking assembly 60, a spiral spring 70, a lateral cover 80 and a housing 90.

The frame 10 includes a frame body 12 and a hanging ring 14 which is engaged with a top of the frame body 12. The frame body 12 forms a receiving space. The frame body 12 has two side plates 121, 122 which face each other. Two perforations 123, 124 are respectively and correspondingly disposed on the side plates 121, 122. Moreover, one of the side plates (i.e., the side plate 121) has a blocking portion 125. Preferably, in the current embodiment, the side plate 121 has two blocking portions 125. The hanging ring 14 is adapted to be connected to or fixed on a stable support as a pivot. The support could be a cable or a post, etc. However, the support is not limited to the examples given above.

The shaft 20 is disposed on the frame 10. In the current embodiment, two ends of the shaft 20 respectively penetrate through the perforations 123, 124 of the side plates 121, 122.

Figure 7:
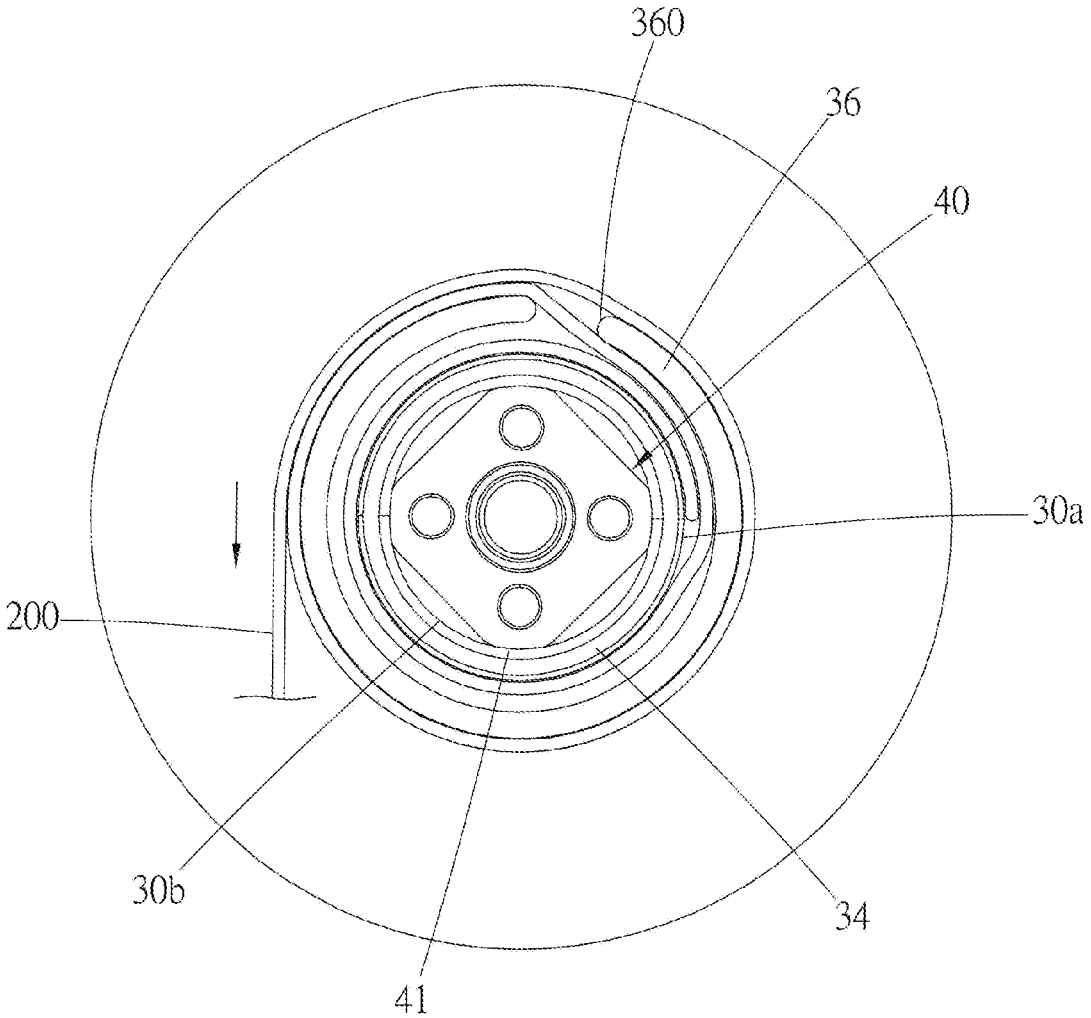
FIG. 7 is a side view, disclosing the relationship among the decelerating member, the safety belt base and the safety belt.

The safety belt base 30 fits around the shaft 20 and is located in the receiving space. The safety belt base 30 has an outer peripheral surface 30*a* and an inner peripheral surface 30*b*, wherein the outer peripheral surface 30*a* is used to be wrapped by the safety belt 200. In the current embodiment, the safety belt base 30 includes a base plate 32, a sleeve 34, and a ring 36. Both of the sleeve 34 and the ring 36 are connected to a side of the base plate 32. As shown in FIG. 7, the sleeve 34 has the outer peripheral surface 30*a* and the inner peripheral surface 30*b*. The ring 36 surrounds a periphery of the sleeve 34 and has an opening gap 360. An end of the safety belt 200 is connected to or wound around the outer peripheral surface 30*a* of the sleeve 34, wherein a part of the safety belt 200 passes through the opening gap 360 and winds around an outer peripheral surface of the ring 36. In an embodiment, the ring 36 could be omitted, wherein the safety belt 200 winds around the outer peripheral surface 30*a* of the sleeve 34.

The decelerating member 40 is disposed in the receiving space and is connected to the shaft 20. An outer peripheral surface of the decelerating member 40 has a plurality of friction surfaces 41 arranged at intervals. In this embodiment, the decelerating member 40 has a perforation 42 and a plurality of positioning holes 44 which are disposed around the perforation 42. The perforation 42 of the decelerating member 40 is adapted to be passed through and connected by the shaft 20. In an embodiment, the decelerating member 40 and the shaft 20 could be integrally formed as a monolithic unit. The friction surfaces 41 of the decelerating member 40 extend along an axial direction of the decelerating member 40 and is arranged at intervals.

Figure 4:
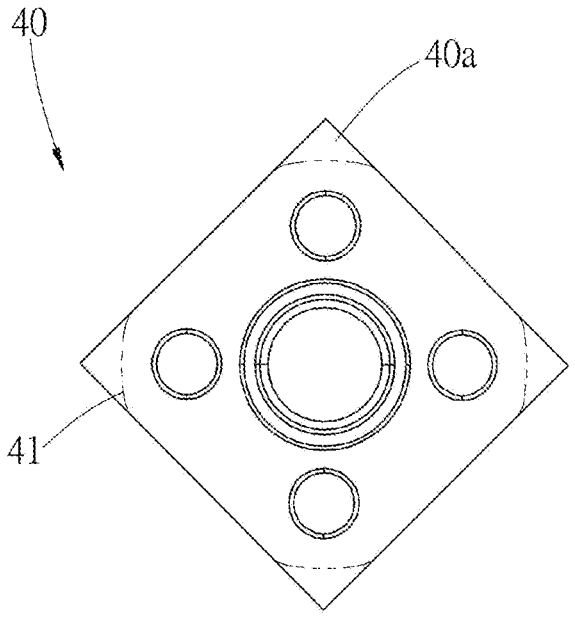
FIG. 4 is a side view, showing the decelerating member of the fall protection device according to the embodiment shown in FIG. 1.
Figure 5:
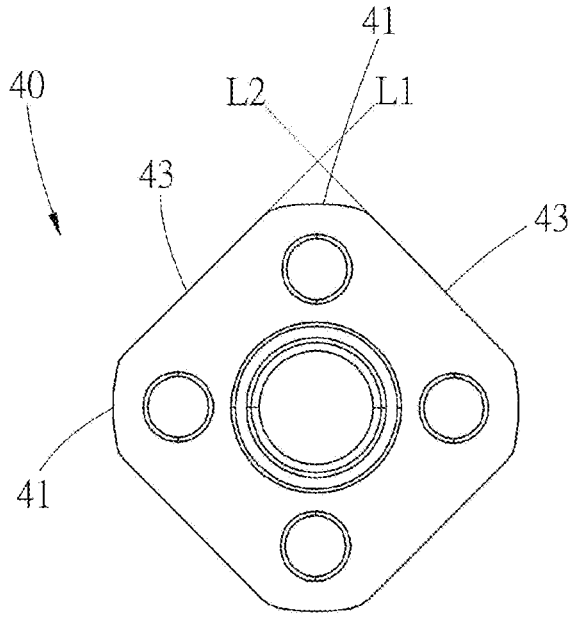
FIG. 5 is a side view, showing the decelerating member of the fall protection device according to the embodiment shown in FIG. 1.

According to FIG. 4, and FIG. 5, in the current embodiment, the decelerating member 40 is formed by processing a square post. For instance, the friction surfaces 41 could be formed by processing four edges of the square post. For example, a process, such as polishing, lapping, cutting, and etc., could be used to get rid of four angles 40*a* of the square post, in order to form the friction surfaces 41 in an arc shape. However, in other embodiments, the decelerating member 40 could be formed by processing edges of a polygonal prism to form the friction surfaces, wherein the polygonal prism could be regular triangle column, regular pentagonal column, regular hexagonal column, and etc.

As illustrated in FIG. 5, the outer peripheral surface of the decelerating member 40 further has a plurality of connecting surfaces 43, wherein each of the connecting surfaces 43 is connected between any two adjacent friction surfaces 41. In this embodiment, each of the connecting surfaces 43 is a flat surface. It shall be noted that each of the friction surfaces 41 is disposed inside of an area surrounded by two extending surfaces L1, L2 of any two adjacent connecting surfaces 43. With the aforementioned design, the decelerating member 40 could be lightweight.

With the aforementioned design, the decelerating member 40 of the present invention could be easily and quickly produced. As an example, the decelerating member 40 could be produced by simply processing angles of a regular polygonal prism to form the friction surfaces thereof.

The braking plate 50 has a central hole 52 which is adapted to be connected with an end of the shaft 20. According to this embodiment, the shape of the central hole 52 is square. The end of the shaft 20 which the central hole 52 conjugates has a positioning portion 22, and the positioning portion 22 is wedged in the central hole 52, so that the shaft 20 and the braking plate 50 could rotate synchronously. In addition, the braking plate 50 further has a plurality of positioning holes 54. In an embodiment, the braking plate 50 could be fixed to the decelerating member 40 by threading a plurality of positioning members 53, such as a bolt, through the positioning holes 54, so that the braking plate 50 could move synchronously with the decelerating member 40. As a result, all of the shaft 20, the braking plate 50, and the decelerating member 40 rotate synchronously.

The braking assembly 60 includes a braking part 62 and a restoring spring 64, wherein the braking part 62 is pivotally disposed on the braking plate 50. An end of the restoring spring 64 is connected to an end of the braking part 62, while another end of the restoring spring 64 is connected to the braking plate 50. The restoring spring 64 provides an elastic force to urge the braking part 62 to normally stay at a restoring position, so that the braking part 62 doesn't in contact with the frame 10. In the current embodiment, there are two sets of braking assembles 60 disposed on the braking plate 50.

The spiral spring 70 is disposed inside of the lateral cover 80, and an end 72 of the spiral spring 70 is connected to the shaft 20. In the current embodiment, the end 72 of the spiral spring 70 is connected to a groove 24 of the shaft 20. Another end 74 of the spiral spring 70 is engaged with the lateral cover 80. Both of the spiral spring 70 and the lateral cover 80 are connected to a side of the other side plate (i.e., the side plate 122) which faces a direction away from the side plate 121.

The housing 90 is adapted to receive the frame 10, the shaft 20, the safety belt base 30, the decelerating member 40, the braking plate 50, the braking assembly 60, and etc. In the current embodiment, the housing 90 includes a first half portion 92 and a second half portion 94 which could be engaged with the first half portion 92.

With the aforementioned design, a first operating condition is defined when the user is in a safe condition (i.e., before the falling happens). For instance, the user walking on a platform or on a pallet. Under the first operating condition, the braking assembly 60 is at the restoring position without being in contact with the blocking portion 125 of the frame 10. At this time, both of the braking plate 50 and the decelerating member 40 rotate coaxially along with the safety belt base 30 (i.e., the both of the braking plate 50 and the decelerating member 40 rotate along with the safety belt base at the same time). When the safety belt 200 is pulled and unwrapped, for example, when the user moves away from the fall protection device 100 to pull the safety belt 200, the spiral spring 70 is stretched with the stretched safety belt 200 to provide a recovery force (or an elastic force) for recovering to its rolling form. When the user approaches the fall protection device 100, a force which pulls the safety belt 200 becomes weak and is weaker than the elastic force of the spiral spring 70, so that the spiral spring 70 recovers to its rolling form and wraps or rolls the safety belt 200 back to the safety belt base 30.

Figure 6:
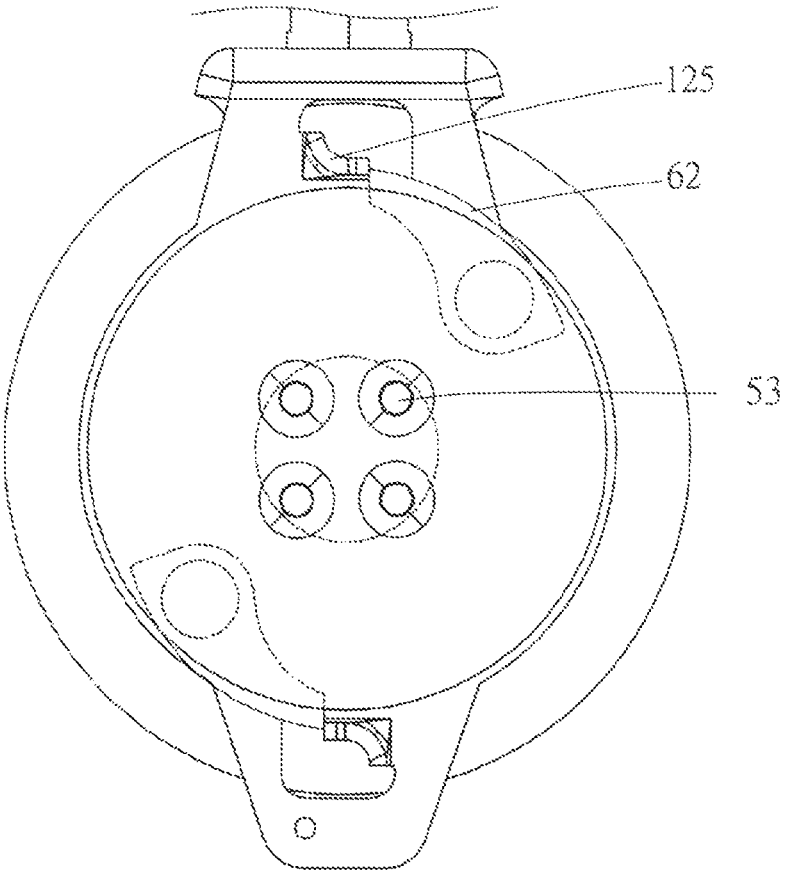
FIG. 6 is a schematic diagram, showing the breaking parts are spun out to be abutted against the blocking portions respectively.

A situation when the safety belt 200 is pulled out rapidly is defined as a second operating situation. As shown in FIG. 6, under the second operating form, the braking part 62 would be spun out by a torque or a centrifugal force which overcomes the elastic force of the restoring spring 64, so that the braking part 62 abuts against the blocking portion 125, and the braking plate 50 is then fixed, and the decelerating member 40 fixed on the braking plate 50 is also fixed to be prevented from rotating. Referring to FIG. 7, the stretched safety belt 200 rotates the safety belt base 30 continuously. Since the inner peripheral surface 30*b* of the safety belt base 30 is in conjunction with the friction surfaces 41 of the decelerating member 40, when the safety belt base 30 rotates relative to the decelerating member 40, the friction surfaces 41 of the decelerating member 40 rubs the inner peripheral surface 30*b* to generate a rolling friction, thereby to slow down or to limit the rotational speed of the safety belt base 30 and to further slow down an unwound speed of the safety belt 200 and the falling speed of the user who is attached to the safety belt 200.

Figure 8:
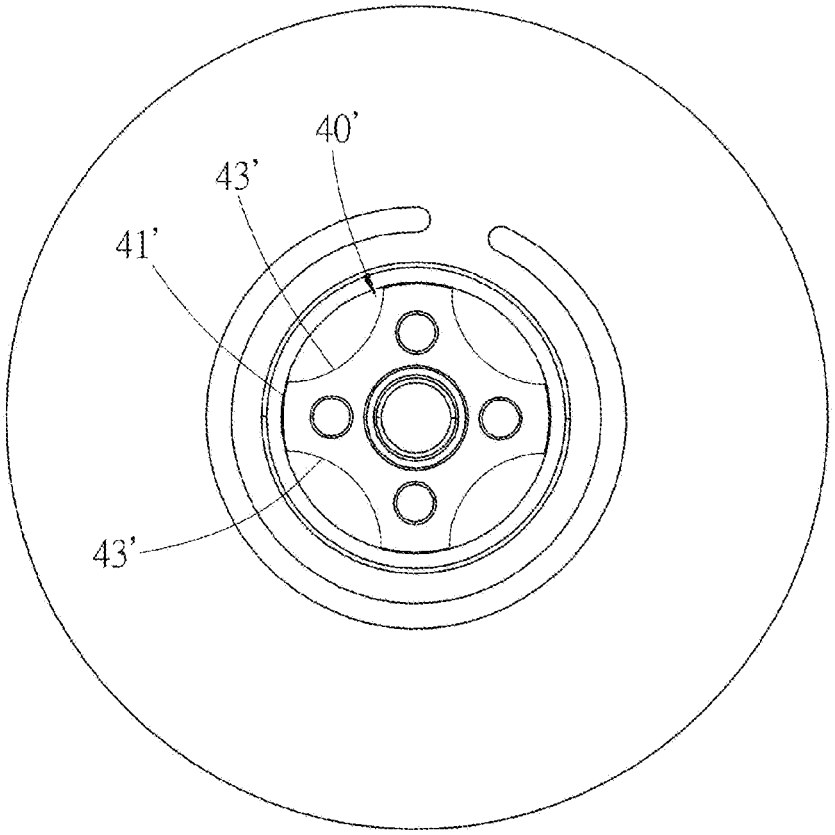
FIG. 8 is a side view of the fall protection device according to another embodiment, showing the decelerating member with different structures.

Referring to FIG. 8, a decelerating member 40' according to another embodiment of the present invention is disclosed, wherein the difference between the decelerating member 40' and the decelerating member 40 of the aforementioned embodiment is that a connecting surface 43' located between any two of friction surfaces 41' is concave in shape, which facilitates to lighten the weight of the decelerating member 40'.

It must be pointed out that the embodiments described above are only some embodiments of the present invention. All equivalent structures which employ the concepts disclosed in this specification and the appended claims should fall within the scope of the present invention

What is claimed is:

1. A fall protection device adapted to be connected to a safety belt, comprising:

a frame having a receiving space;

a shaft disposed on the frame;

a decelerating member connected to the shaft, received in the receiving space, wherein an outer peripheral surface of the decelerating member has a plurality of friction surfaces arranged at intervals; and a safety belt base fitted around the decelerating member, having an outer peripheral surface and an inner peripheral surface, wherein the outer peripheral surface is adapted to be wrapped or be wound by the safety belt, and the inner peripheral surface is in contact with the plurality of friction surfaces of the decelerating member;

wherein the decelerating member has a plurality of positioning holes and a braking plate further has a plurality of positioning holes which corresponds to the plurality of positioning holes of the decelerating member;

a plurality of positioning members, wherein each respective positioning member passes through one of the plurality of positioning holes of the braking plate and the corresponding one of the plurality of positioning holes of the decelerating member to engage the braking plate and the decelerating member.

2. The fall protection device as claimed in claim 1, wherein the decelerating member and the shaft move simultaneously.

3. The fall protection device as claimed in claim 1, wherein the several friction surfaces are formed along an axial direction of the decelerating member.

4. The fall protection device as claimed in claim 1, wherein the decelerating member has a perforation, and the shaft passes through the perforation.

5. The fall protection device as claimed in claim 1, wherein the decelerating member and the shaft are integrally formed as a monolithic unit.

6. The fall protection device as claimed in claim 1, wherein the decelerating member is formed by processing a plurality of edges of a regular polygonal prism to form the friction surfaces.

7. The fall protection device as claimed in claim 1, wherein the outer peripheral surface of the decelerating member has a plurality of connecting surfaces connected between any two adjacent friction surfaces; each of the friction surfaces is disposed inside of an area surrounded by two extending surfaces of any two adjacent connecting surfaces.

8. The fall protection device as claimed in claim 1, wherein the outer peripheral surface of the decelerating member has a plurality of connecting surfaces, and each of the plurality of connecting surfaces is connected between any two adjacent friction surfaces; each of the connecting surfaces is a flat surface.

9. The fall protection device as claimed in claim 1, wherein the outer peripheral surface of the decelerating member has a plurality of connecting surfaces, and each of the plurality of connecting surfaces is connected between any two adjacent friction surfaces; each of the connecting surfaces is concave in shape.

* * * * *